US009606483B2

(12) United States Patent
Ishida et al.

(10) Patent No.: US 9,606,483 B2
(45) Date of Patent: Mar. 28, 2017

(54) FIXING DEVICE

(71) Applicant: Brother Kogyo Kabushiki Kaisha, Nagoya-shi, Aichi-ken (JP)

(72) Inventors: Kei Ishida, Inuyama (JP); Masahito Kajita, Nagoya (JP); Kaoru Suzuki, Ichinomiya (JP); Atsushi Ozawa, Nagoya (JP); Kenji Takeuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/053,782

(22) Filed: Feb. 25, 2016

(65) Prior Publication Data

US 2016/0252855 A1 Sep. 1, 2016

(30) Foreign Application Priority Data

Feb. 27, 2015 (JP) ..... 2015-037894

(51) Int. Cl.
*G03G 15/20* (2006.01)

(52) U.S. Cl.
CPC ..... *G03G 15/2053* (2013.01); *G03G 15/2017* (2013.01); *G03G 2215/2016* (2013.01); *G03G 2215/2035* (2013.01)

(58) Field of Classification Search
CPC ..... G03G 15/2017; G03G 15/2053; G03G 2215/2016; G03G 2215/2035
USPC ..... 399/329
See application file for complete search history.

(56) References Cited

U.S. PATENT DOCUMENTS

| | | | | |
|---|---|---|---|---|
| 8,918,041 | B2 | 12/2014 | Kobashigawa | |
| 8,965,259 | B2 | 2/2015 | Sahara | |
| 9,046,832 | B2 | 6/2015 | Samei et al. | |
| 2009/0110451 | A1* | 4/2009 | Jung | G03G 15/2064 399/329 |
| 2009/0175645 | A1* | 7/2009 | Seol | G03G 15/2039 399/69 |
| 2010/0158587 | A1* | 6/2010 | Shin | G03G 15/2039 399/329 |

(Continued)

FOREIGN PATENT DOCUMENTS

| | | | |
|---|---|---|---|
| JP | 2012-063463 | A | 3/2012 |
| JP | 2012-234105 | A | 11/2012 |

(Continued)

*Primary Examiner* — David Gray
*Assistant Examiner* — Tyler Hardman
(74) *Attorney, Agent, or Firm* — Banner & Witcoff, Ltd.

(57) ABSTRACT

A fixing device includes an endless belt, a nip member, a heater, a reflecting member, a load receiving member, and a protective member. The endless belt has end portions in the first direction and a middle portion defined between the end portions. The nip member is configured to contact an inner circumferential surface of the endless belt. The heater is disposed inside the endless belt. The reflecting member is entirely disposed on a nip-member side with respect to the heater and is configured to reflect radiant heat emitted from the heater toward the inner circumferential surface. The protective member is disposed between the middle portion of the endless belt and the heater and on a side opposite to the nip member with respect to the heater, and is configured to allow light to pass therethrough. The protective member is fastened to the load receiving member.

17 Claims, 10 Drawing Sheets

(56) References Cited

U.S. PATENT DOCUMENTS

| | | | | |
|---|---|---|---|---|
| 2012/0288308 | A1* | 11/2012 | Kobashigawa | G03G 15/2017 399/329 |
| 2013/0045032 | A1* | 2/2013 | Shimokawa | G03G 15/2053 399/329 |
| 2013/0136515 | A1* | 5/2013 | Sahara | G03G 15/2007 399/329 |
| 2013/0251422 | A1* | 9/2013 | Iwaya | G03G 15/2053 399/329 |
| 2013/0308990 | A1* | 11/2013 | Samei | G03G 15/2053 399/329 |
| 2014/0169820 | A1* | 6/2014 | Kusumoto | G03G 15/2053 399/69 |
| 2015/0104229 | A1 | 4/2015 | Sahara | |
| 2016/0091852 | A1* | 3/2016 | Matsuno | G03G 15/657 399/322 |
| 2016/0132004 | A1* | 5/2016 | Yamagishi | G03G 15/2053 399/329 |

FOREIGN PATENT DOCUMENTS

| | | | |
|---|---|---|---|
| JP | 2013-097238 | A | 5/2013 |
| JP | 2013-114036 | A | 6/2013 |
| JP | 2013-242383 | A | 12/2013 |

* cited by examiner

FIXING DEVICE

CROSS-REFERENCE TO RELATED APPLICATION

This application claims priority from Japanese Patent Application No. 2015-037894, filed on Feb. 27, 2015, which is incorporated herein by reference in its entirety.

TECHNICAL FIELD

The disclosure relates to a fixing device for fixing a developer image onto a recording sheet by heat.

BACKGROUND

A known fixing device includes an endless belt, a heater, a reflecting member, and a pair of side guides. The heater is disposed inside the endless belt. The reflecting member reflects radiant heat emitted by the heater toward an inner circumferential surface of the endless belt. The side guides guide corresponding edge portions of the endless belt.

SUMMARY

In the known fixing device, while the both edge portions of the endless belt in a lengthwise direction of the endless belt are supported by the corresponding side guides, a middle portion of the endless belt in the lengthwise direction might not be supported by any member or component. Therefore, the endless belt may sink downward in its middle, whereby the middle portion of the endless belt may contact the heater.

According to one or more aspects of the disclosure, a fixing device may include an endless belt, a nip member, a heater, a reflecting member, a load receiving member, and a protective member. The endless belt may extend in a first direction and have end portions in the first direction and a middle portion defined between the end portions in the first direction. The nip member may be configured to contact an inner circumferential surface of the endless belt. The heater may be disposed inside the endless belt. The reflecting member may be entirely disposed on a nip-member side with respect to the heater and may be configured to reflect radiant heat emitted from the heater toward the inner circumferential surface of the endless belt. The load receiving member may be configured to receive a load from the nip member. The protective member may be disposed between the middle portion of the endless belt and the heater and on a side opposite to the nip member with respect to the heater, and may be configured to allow light to pass therethrough. The protective member may be fastened to the load receiving member.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments of the disclosure will be described in detail with reference to the accompanying drawings. With reference to a color laser printer 1, directions of up, down, right, left, front, and rear may be defined with reference to an orientation of the color laser printer 1 that is disposed in which it is intended to be used as depicted in FIG. 1.

Figure 1:
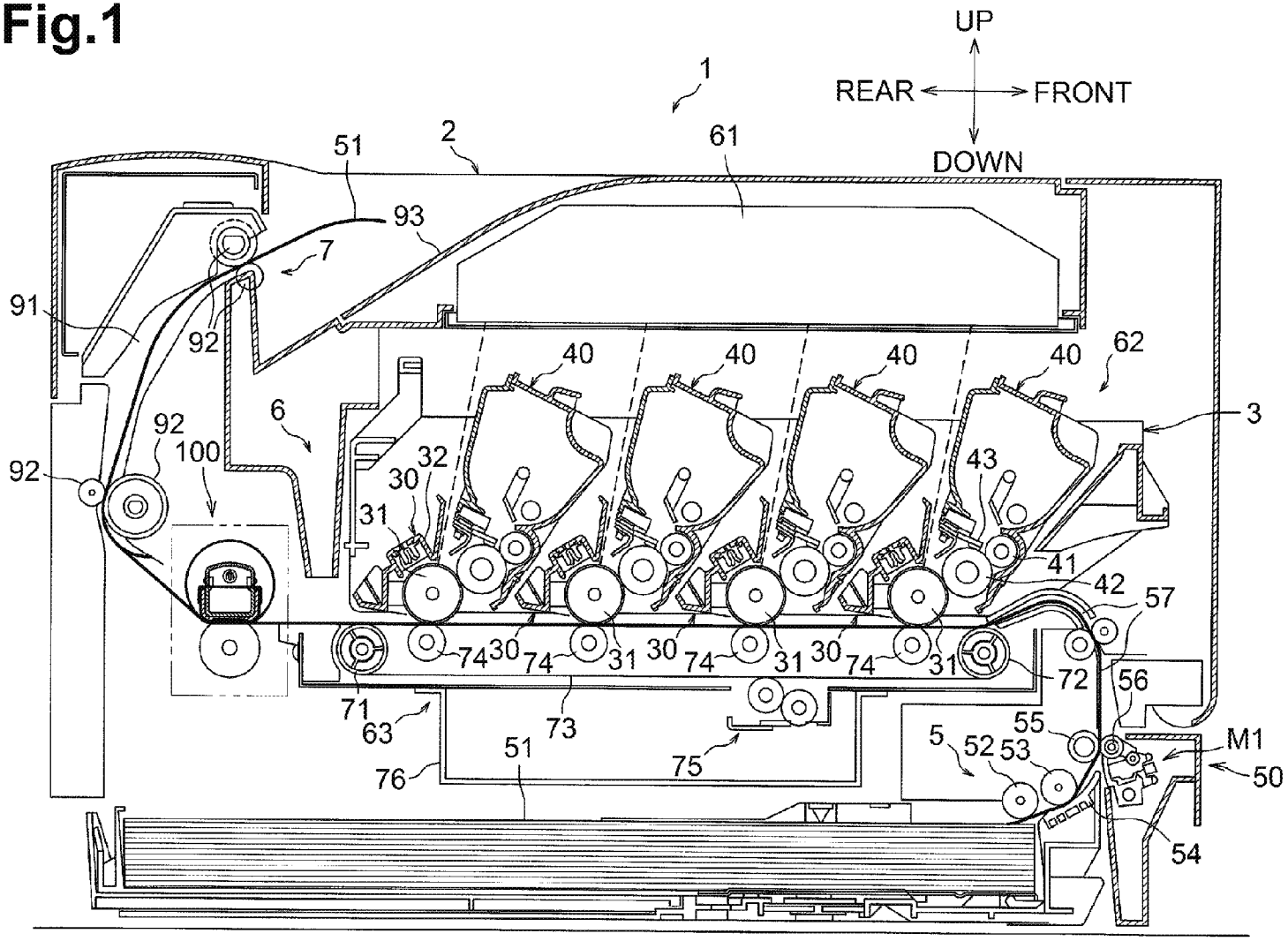
FIG. 1 is a cross-sectional view depicting a color laser printer including a fixing device in an illustrative embodiment according to one or more aspects of the disclosure.

As depicted in FIG. 1, the color laser printer 1 includes a feed unit 5, an image forming unit 6, and a discharge unit 7 within a housing 2 of the color laser printer 1. The feed unit 5 feeds one or more sheets 51 therefrom. The image forming unit 6 forms an image onto each of one or more fed sheets 51. The discharge unit 7 discharges one or more sheets 51 each having an image thereon to the outside of the housing 2.

The feed unit 5 is disposed in a lower portion of the housing 2. The feed unit 5 includes a feed tray 50 and a feed mechanism M1. The feed tray 50 is configured to be attached to and detached from the housing 2 from the front of the housing 2 through a sliding operation. The feed mechanism M1 feeds one or more sheets 51, one by one, from the feed tray 50 toward the image forming unit 6.

The feed mechanism M1 includes a pickup roller 52, a separation roller 53, and a separation pad 54, which are disposed near a front end portion of the feed tray 50 and cooperate with each other to feed one or more sheets 51 upward, one by one, from the feed tray 50. An upwardly-fed sheet 51 passes between a paper-dust removing roller 55 and a pinch roller 56 and further moves through a conveying path 57. A moving direction of the sheet 51 is changed to the rear while the sheet 51 moves in the conveying path 57. Thereafter, the sheet 51 is supplied onto a conveyor belt 73.

The image forming unit 6 includes a scanner unit 61, a process unit 62, a transfer unit 63, and a fixing device 100.

The scanner unit 61 is disposed in an upper portion of the housing 2. The scanner unit 61 includes a laser emitting portion, a polygon mirror, lenses, and reflectors. In the scanner unit 61, the laser emitting portion emits laser beams corresponding to respective colors, for example, cyan, magenta, yellow, and black, and the polygon mirror scans the emitted laser beams in a right-left direction at high speed. After the laser beams pass or are reflected off the lenses and the reflectors, the laser beams are irradiated onto corresponding photosensitive drums 31 provided for the respective colors.

The process unit 62 is disposed below the scanner unit 61 and above the feed unit 5. The process unit 62 includes a photosensitive body unit 3. The photosensitive body unit 3 is capable of moving in a front-rear direction relative to the housing 2. The photosensitive body unit 3 includes drum sub units 30 and developing cartridges 40. The developing cartridges 40 are attachable to the corresponding drum sub units 30. All of the drum sub units 30 have the same or similar configuration to each other and behave in the same or similar manner to each other. All of the developing cartridges 40 also have the same or similar configuration to each other and behave in the same or similar manner to each other. Therefore, a detailed description will be given on one of the drum sub units 30 and one of the developing cartridges 40.

The drum sub unit 30 includes a known photosensitive drum 31 and a scorotron charger 32.

The developing cartridge 40 stores toner therein. Toner is an example of a developer. The developing cartridge 40 includes a supply roller 41, a developing roller 42, and a layer-thickness regulating blade 43.

In the process unit 62, the supply roller 41 supplies toner onto a surface of the developing roller 42 from the developing cartridge 40 while toner is positively charged by friction caused between the supply roller 41 and the developing roller 42. Then, the layer thickness regulating blade 43 rubs over the surface of the developing roller 42 carrying thereon toner supplied from the supply roller 41 in accordance with rotation of the developing roller 42. Thus, toner becomes a thin layer having a certain thickness and is held on the surface of the developing roller 42.

In the drum sub unit 30, the scorotron charger 32 charges a surface of the photosensitive drum 31 uniformly by corona discharge. A laser beam is emitted onto the charged surface of the photosensitive drum 31 from the scanner unit 61 to form an electrostatic latent image onto the surface of the photosensitive drum 31.

Thereafter, the developing roller 42 supplies toner held on its surface onto the electrostatic latent image formed on the surface of the photosensitive drum 31. Thus, the electrostatic latent image formed on the surface of the photosensitive drum 31 is visualized using toner of one of the colors. Therefore, the photosensitive drum 31 carries a toner image obtained through a reversal development on its surface.

The transfer unit 63 includes a drive roller 71, a driven roller 72, the conveyor belt 73, transfer rollers 74, and a cleaning unit 75.

The drive roller 71 and the driven roller 72 extend parallel to each other while being spaced apart from each other in the front-rear direction. The conveyor belt 73 is looped around the drive roller 71 and the driven roller 72. The conveyor belt 73 may be an endless belt. The conveyor belt 73 has an outer circumferential surface, which is in contact with the surfaces of the photosensitive drums 31. The transfer rollers 74 are disposed inside the loop of the conveyor belt 73. The transfer rollers 74 pinch the conveyor belt 73 with the corresponding photosensitive drums 31 therebetween. A transfer bias is applied to the transfer rollers 74. At the time of forming an image onto a sheet 51, the sheet 51 conveyed by the conveyor belt 73 is pinched between one or more of the photosensitive drums 31 and one or more corresponding ones of the transfer rollers 74 and one or more toner images are transferred onto the sheet 51 from the one or more of the photosensitive drums 31.

The cleaning unit 75 is disposed below the conveyor belt 73. A toner storage 76 is disposed below the cleaning unit 75. The cleaning unit 75 removes toner adhering the outer circumferential surface of the conveyor belt 73 therefrom, and thus, toner drops to the toner storage 76 from the conveyor belt 73.

The fixing device 100 is disposed behind the transfer unit 63. The fixing device 100 fixes, onto a sheet 51, one or more toner images transferred onto the sheet 51 by heat.

A discharge path 91 is defined in the discharge unit 7. The discharge path 91 extends upward from the exit of the fixing device 100 and curves toward the front. A plurality of conveying rollers 92 define portions of the discharge path 91. The plurality of conveying rollers 92 is configured to convey a sheet 51. The housing 2 includes a discharge tray 93. The top of the housing 2 functions as the discharge tray 93 for supporting one or more sheets 51 on which printing has been performed. One or more sheets 51 discharged by the conveyor rollers 92 through the discharge path 91 are supported by the discharge tray 93.

Figure 2:
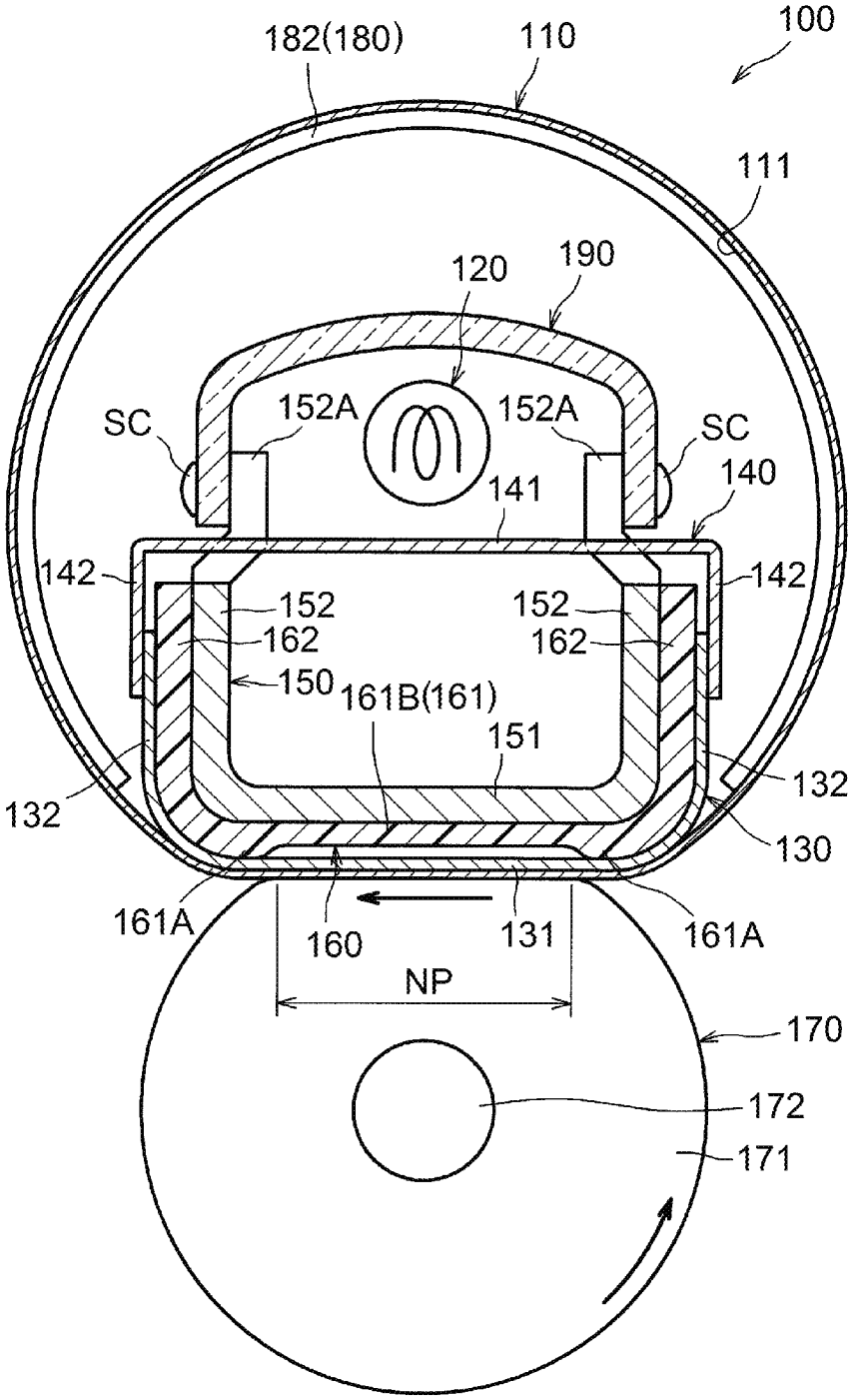
FIG. 2 is a cross-sectional view depicting the fixing device in the illustrative embodiment according to one or more aspects of the disclosure.
Figure 3:
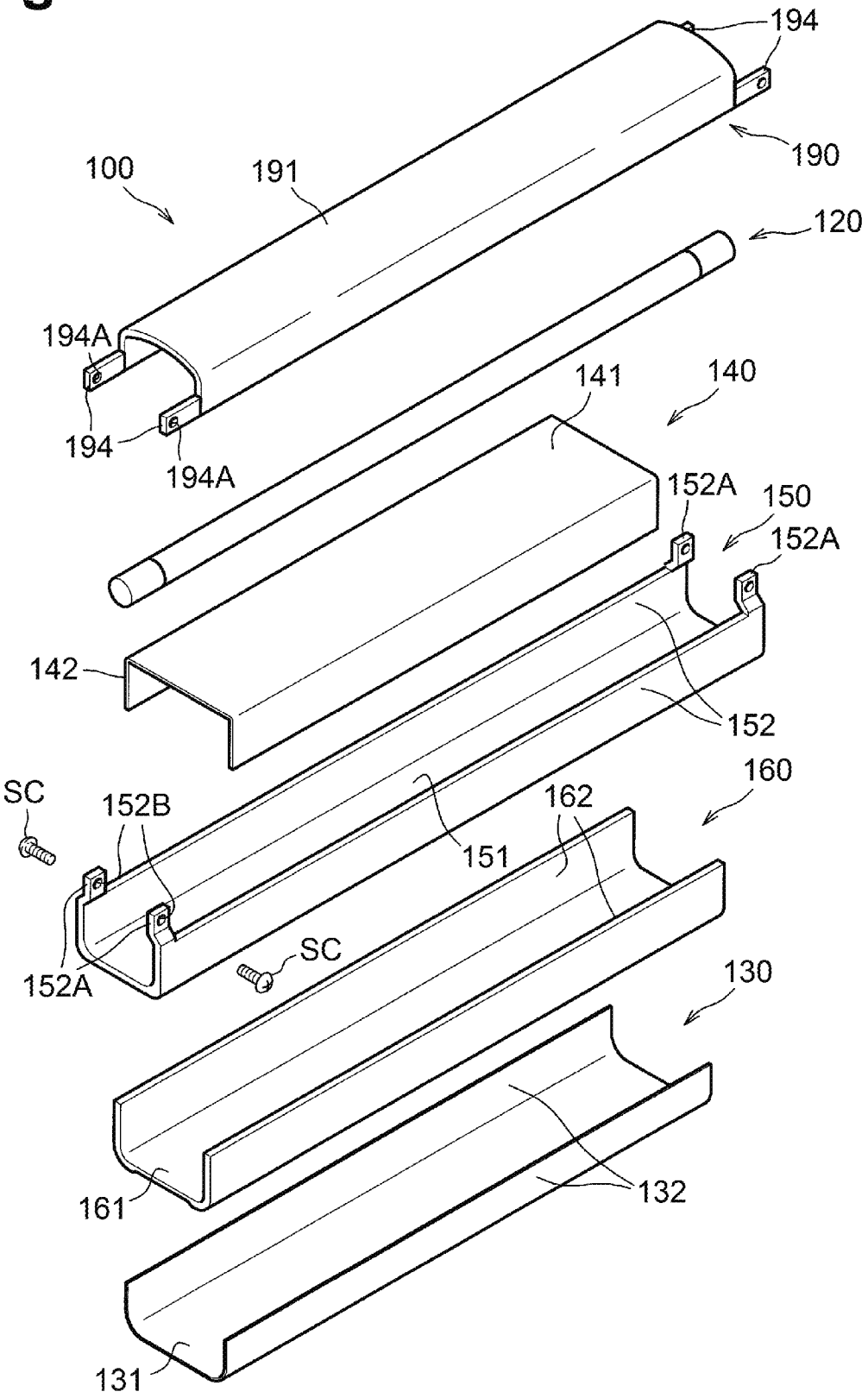
FIG. 3 is a perspective view depicting a nip plate, a heat insulating member, a stay, a reflecting plate, a halogen lamp, and a protective member which are disassembled from each other in the illustrative embodiment according to one or more aspects of the disclosure.

As depicted in FIGS. 2 and 3, the fixing device 100 includes a fixing belt 110, a halogen lamp 120, a nip plate 130, a reflecting plate 140, a stay 150, a heat insulating member 160, a pressing roller 170, and a protective member 190. The fixing belt 110 is an example of an endless belt. The halogen lamp 120 is an example of a heater. The nip plate 130 is an example of a nip member. The reflecting plate 140 is an example of a reflecting member. Each of the stay 150 and the heat insulating member 160 are an example of a load receiving member.

Hereinafter, a direction that a sheet 51 is conveyed (e.g., substantially a front-to-rear direction) may be simply referred to as a "conveying direction", and a direction that the fixing belt 110 extends, i.e., a direction that longer sides of the fixing belt 110 extend, (e.g., substantially the right-left direction) may be simply referred to as a "lengthwise direction". The conveying direction corresponds to a sliding direction that the fixing belt 110 slides relative to the nip plate 130, i.e., a direction that the fixing belt 110 moves at a nip point NP. The lengthwise direction of the fixing belt 110 corresponds to a direction that an axis of the pressing roller 170 extends.

The fixing belt 110 may be an annular endless belt having heat resistance and flexibility. The fixing belt 110 is configured to rotate. The fixing belt 110 is supported by side guides 180 (refer to FIG. 4) at edge portions of the fixing belt 110 in the lengthwise direction. The fixing belt 110 has an inner circumferential surface 111 having grease applied thereto for reducing frictional resistance against the nip plate 130.

In one example, the fixing belt 110 may be a metallic belt including a metal base material and a coat of resin applied to one surface (e.g., an outer circumferential surface) of the metal base material. In another example, the fixing belt 110 may have a rubber layer on the outer circumferential surface of the metal base material. In still another example, the fixing belt 110 may further have a nonmetal protective layer on a surface of the rubber layer with fluorine coating. The fixing belt 110 may include a base material made of resin, e.g., polyimide, instead of the metal base material.

The halogen lamp 120 may be a heating element for heating the fixing belt 110 so as to heat toner held by a sheet 51. The halogen lamp 120 is disposed inside the loop of the fixing belt 110 while being spaced from the inner circumferential surface 111 of the fixing belt 110 by a predetermined gap.

The nip plate 130 is disposed inside the loop of the fixing belt 110 and lower than the halogen lamp 120. The nip plate 130 is in contact with a portion of the inner circumferential surface 111 of the fixing belt 110. The nip plate 130 includes a metal plate having a substantially U shape in cross section. The metal plate may be, for example, an aluminum plate or a stainless plate.

For example, the nip plate 130 includes a base portion 131 and sidewall portions 132. The base portion 131 extends along the front-rear direction when viewed in cross section extending orthogonal to the lengthwise direction. The sidewall portions 132 extend from front and rear ends, respectively, of the base portion 131 in a direction away from the pressing roller 170. The direction away from the pressing roller 170 refers to a direction intersecting the conveying direction at the nip point NP and away from the pressing roller 170.

The base portion 131 has a rectangular plate-like shape and has longer sides extending along the lengthwise direction. The base portion 131 has a lower surface that is in contact with a portion of the inner circumferential surface 111 of the fixing belt 110.

The sidewall portions 132 each have a rectangular plate-like shape and longer sides extending along the lengthwise direction.

The reflecting plate 140 is configured to reflect radiant heat (e.g., light) emitted from the halogen lamp 120 toward the inner circumferential surface 111 of the fixing belt 110 to expose the inner circumferential surface 111 to the radiant heat. The reflecting plate 140 is disposed between the halogen lamp 120 and the nip plate 130 (more specifically, for example, the base portion 131) while being disposed inside the loop of the fixing belt 110. In other words, the reflecting plate 140 is disposed below the halogen lamp 120 and is configured to reflect radiant heat emitted from the halogen lamp 120 upward, e.g., in a direction away from the nip plate 130. That is, the reflecting plate 140 might not be positioned between a reflecting surface of the reflecting plate 140 and the fixing belt 110.

The reflecting plate 140 includes a metal plate having a substantially U shape in cross section. The metal plate may be, for example, an aluminum plate or a stainless plate.

For example, the reflecting plate 140 includes a base portion 141 and sidewall portions 142. The base portion 141 extends along the front-rear direction when viewed in cross section extending orthogonal to the lengthwise direction. The sidewall portions 142 extend toward the pressing roller 170. The sidewall portions 142 of the reflecting plate 140 are positioned closer to the fixing belt 110 in the front-rear direction than the corresponding sidewall portions 132 of the nip plate 130 while partially overlapping and covering the corresponding sidewall portions 132 of the nip plate 130. The sidewall portions 142 of the reflecting plate 140 are positioned adjacent to the corresponding sidewall portions 132 of the nip plate 130, respectively.

The stay 150 may be a metal frame for ensuring rigidity of the nip plate 130. The stay 150 is disposed opposite to the halogen lamp 120 relative to the reflecting plate 140. The stay 150 supports the nip plate 130 via the heat insulating member 160. The stay 150 may be made of metal having a relatively higher rigidity, for example, a steel plate. The stay 150 includes a metal plate having a substantially U shape in cross section.

Figure 4:
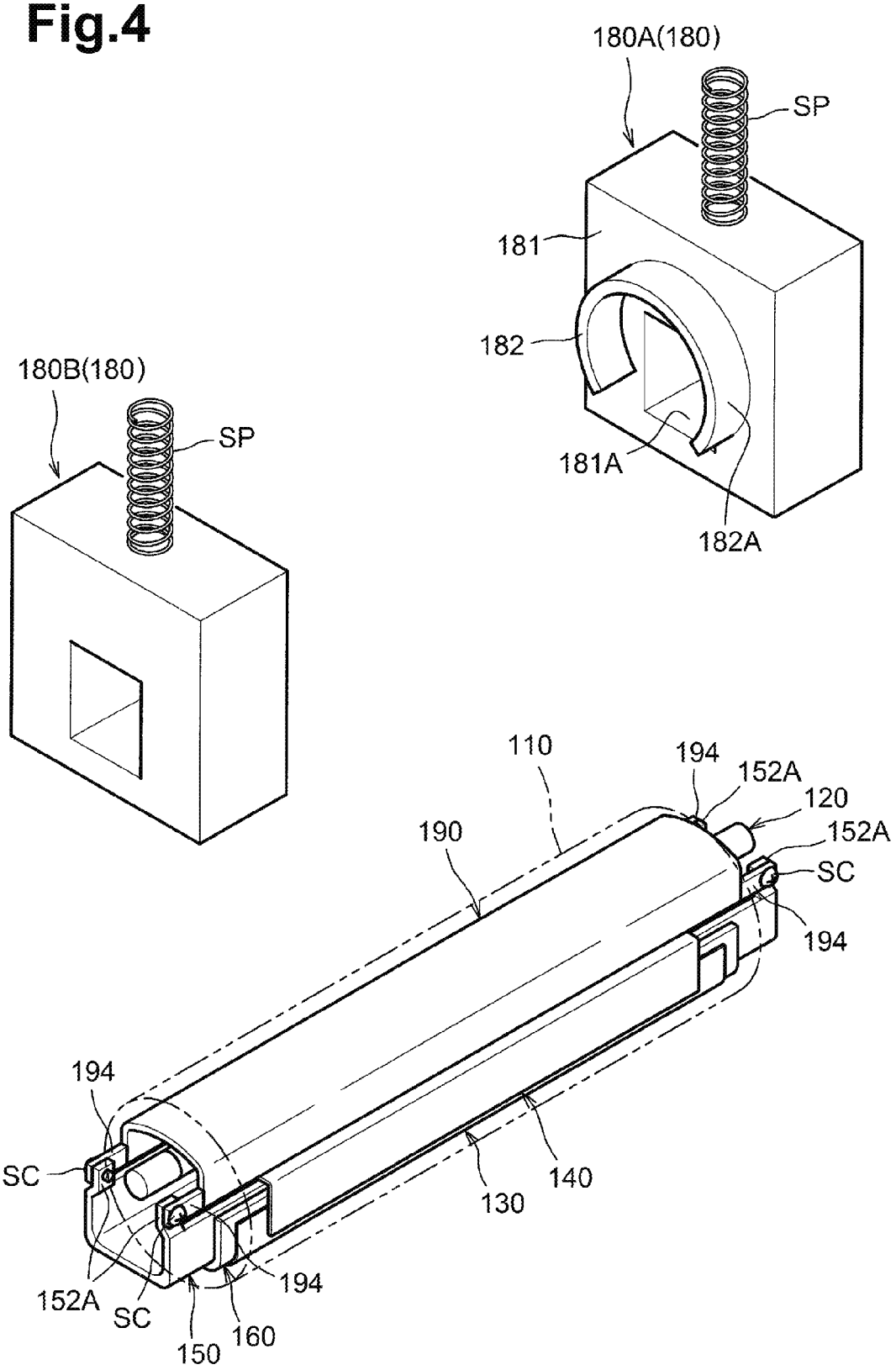
FIG. 4 is a perspective view depicting side guides and an assembly of the nip plate, the heat insulating member, the stay, the reflecting plate, the halogen lamp, and the protective member in the illustrative embodiment according to one or more aspects of the disclosure.
Figure 5:
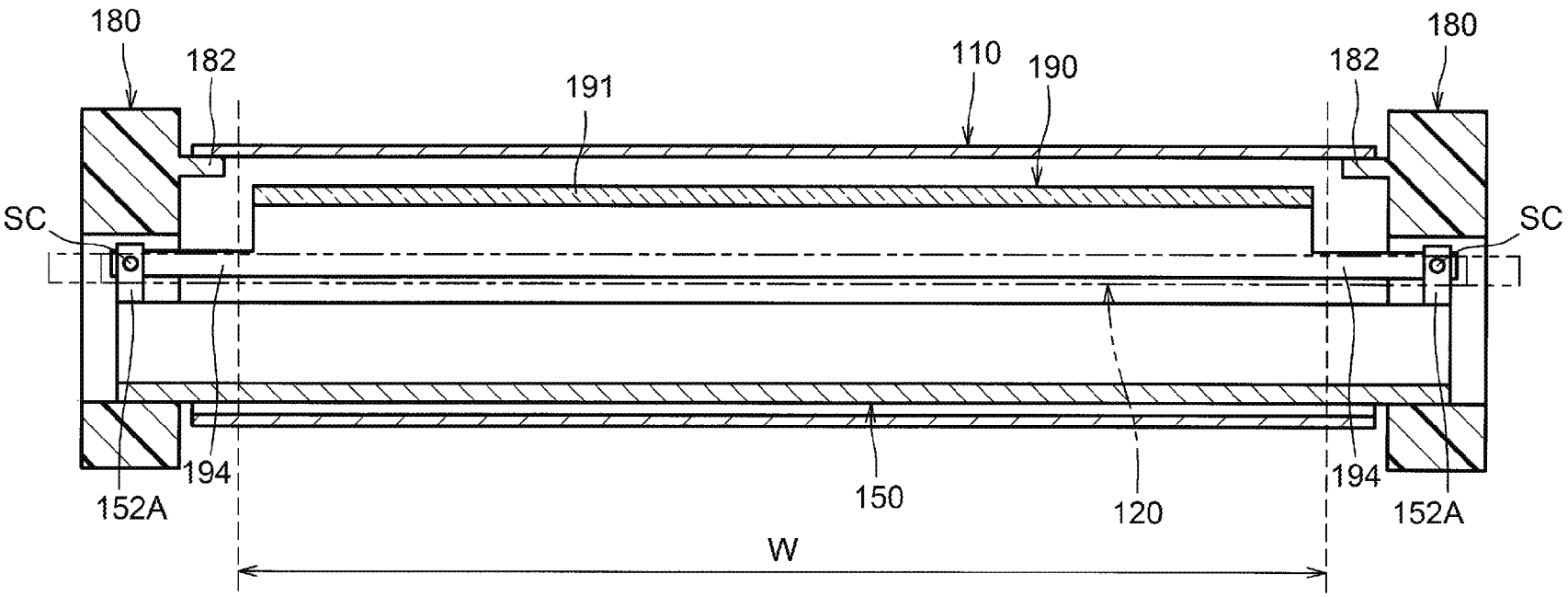
FIG. 5 illustrates the protective member and its surrounding components in section taken along a plane extending orthogonal to a front-rear direction in the illustrative embodiment according to one or more aspects of the disclosure.

For example, the stay 150 includes a base portion 151 and sidewall portions 152. The base portion 151 extends along the front-rear direction when viewed in cross section extending orthogonal to the lengthwise direction. The sidewall portions 152 extend from front and rear ends, respectively, of the base portion 151 in a direction away from the pressing roller 170. As depicted in FIGS. 4 and 5, the stay 150 is longer in length in the lengthwise direction than the fixing belt 110, the nip plate 130, the reflecting plate 140, and the heat insulating member 160, and both end portions of the stay 150 in the lengthwise direction are located beyond the length of the fixing belt 110 (hereinafter, referred to as an "exposed end portion"). The stay 150 is fastened to the side guides 180. For convenience in drawing, the nip plate 130, the reflecting plate 140, and the heat insulating member 160 are omitted in FIG. 5.

The stay 50 includes a plurality of, for example, four, mounting portions 152A in total at the exposed end portions of the sidewall portions 152. The mounting portions 152A are used for attaching the protective member 190 to the stay 50. More specifically, for example, as depicted in FIGS. 2 and 3, each of the mounting portions 152A is disposed on an upper edge of one of the sidewall portions 152 and at each of the exposed end portions of one of the sidewall portions 152 in the lengthwise direction. Each of the mounting portions 152A extends diagonally upward toward an opposite one of the mounting portions 152A in the front-rear direction from the upper edge of one of the sidewall portions 152, and further extends upward. Each of the mounting portions 152A has a mounting hole 152B at a distal end portion thereof. Each of the mounting holes 152B is configured to allow a screw SC to pass therethrough for fastening the protective member 190 to the stay 150.

The heat insulating member 160 may be a frame made of resin for reducing heat transmission from the nip plate 130 to the stay 150. The heat insulating member 160 is disposed between the nip plate 130 and the stay 150. The heat insulating member 160 has a substantially U shape extending along the shapes of the nip plate 130 and the stay 150. For example, the heat insulating member 160 includes a base portion 161 and sidewall portions 162. The base portion 161 extends along the front-rear direction when viewed in cross section extending orthogonal to the lengthwise direction. The sidewall portions 162 extend from front and rear ends, respectively, of the base portion 161 in a direction away from the pressing roller 170. The heat insulating member 160 may be made of, for example, liquid crystal polymer ("LCP"), which is heat-resistant resin.

The base portion 161 includes front and rear end portions 161A and a middle portion 161B in the front-rear direction. Both of the end portions 161A protrude downward relative to the middle portion 161B. The protruding end portions 161A of the base portion 161 are in contact with the nip plate 130, whereby air exists in a gap between the middle portion 161B and the nip plate 130.

One of the sidewall portions 162 is disposed upstream of the stay 150 in the conveying direction and the other of the sidewall portions 162 is disposed downstream of the stay 150 in the conveying direction. That is, the upstream sidewall portion 162 corresponds to an upstream wall, the downstream sidewall portion 162 corresponds to a downstream wall, and the base portion 161 corresponds to an intermediate wall connecting between the upstream wall and the downstream wall.

The reflecting plate 140, the stay 150, and the heat insulating member 160 may be joined to each other in any manner. In one example, the heat insulating member 160 may include one or more tabs at each of the sidewall portions 162. The tabs may protrude outward in the front-rear direction from each of the sidewall portions 162. The tabs may be engaged with an exterior of the reflecting plate 140 while passing through corresponding holes defined in the stay 150 and in the reflecting plate 140.

The pressing roller 170 pinches the fixing belt 110 in conjunction with the nip plate 130 to form the nip portion NP between the fixing belt 110 and the pressing roller 170. The pressing roller 170 is disposed below the nip plate 130. The pressing roller 170 includes a cylindrical roller body 171 and a shaft 172. The shaft 172 passes through the roller body 171 and is rotatable together with the roller body 171. The roller body 171 may be elastically deformable.

The pressing roller 170 is configured to rotate by transmission of a driving force from a motor (not depicted) disposed within the housing 2. The rotation of the pressing roller 170 causes friction between the pressing roller 170 and one of the fixing belt 110 and a sheet 51 held by the fixing belt 110, which causes rotation of the fixing belt 110.

As depicted in FIG. 4, the side guides 180 are configured to support the fixing belt 110 and guide rotation of the fixing belt 110. The side guides 180 are disposed opposite to each other relative to the fixing belt 110 in the lengthwise direction. In other words, the side guides 180 include a first side guide 180A and a second side guide 180B. The first side guide 180A supports one of the edge portions of the inner circumferential surface 111 of the fixing belt 110 in the lengthwise direction. The second side guide 180B supports the other of the edge portions of the inner circumferential surface 111 of the fixing belt 110 in the lengthwise direction.

Each of the side guides 180 includes a body portion 181 and a guide portion 182. The body portion 181 supports the stay 150. The guide portion 182 supports the inner circumferential surface 111 of the fixing belt 110 and guide rotation of the fixing belt 110.

The body portion 181 has a support hole 181A that passes therethrough in the lengthwise direction. The body portion 181 holds one of the end portions of the stay 150 in the support hole 181A. A metal plate (not depicted) is disposed within the support hole 181A that supports the halogen lamp 120.

The guide portion 182 may be a wall having an arc shape in cross section. The guide portion 182 protrudes toward the opposite side guide 180 from one of surfaces of the body portion 181. The surface of the body portion 181 from which the guide portion 182 protrudes faces the opposite side guide 180 in the lengthwise direction. The guide portion 182 has an outer circumferential surface, which may be a guide surface 182A that supports the inner circumferential surface 111 of the fixing belt 110 and guides rotation of the fixing belt 110.

Each of the side guides 180 is pressed downward by a corresponding spring SP. Application of pressure to the side guides 180 by the springs SP causes a downward pressing force to exert on the stay 150. The downward pressing force is transmitted to the pressing roller 170 via the heat insulating member 160, the nip plate 130, and the fixing belt 110. In response to this, a reaction force of the pressing force is generated by the pressing roller 170. The stay 150 is configured to receive the reaction force via the fixing belt 110, the nip plate 130, and the heat insulating member 160.

Nevertheless, in other embodiments, for example, the pressing roller 170 may be pressed upward by an elastic member, e.g., a spring. In this case, the stay 150 may be configured to receive a pressing force of the pressing roller 170 via the fixing belt 110, the nip plate 130, and the heat insulating member 160.

As depicted in FIGS. 2 and 3, the protective member 190 may be a transparent or translucent member made of, for example, heat-resistant resin or heat-resistant glass. The protective member 190 is disposed between the fixing belt 110 and the halogen lamp 120. The transparent or translucent member may be a member that allows radiant heat to pass therethrough or a member that may absorb some of radiant heat but allows remainder of the radiant heat to pass therethrough.

The protective member 190 is disposed apart from the fixing belt 110 by a predetermined distance. More specifically, for example, the protective member 190 is disposed at a particular position where, when the fixing belt 110 sinks downward in its middle in the lengthwise direction, the protective member 190 is capable of supporting a middle portion of the inner circumferential surface 111 of the fixing belt 110 in the lengthwise direction. In other words, the protective member 190 is disposed between the halogen lamp 120 and the middle portion of the inner circumferential surface 111 of the fixing belt 110. The middle portion of the fixing belt 110 may be distant from the both edges of the fixing belt 110. The middle portion may refer to a portion of the fixing belt 110 located within a range of a width W of a sheet having the maximum size that the fixing device 100 is capable of conveying therein (refer to FIG. 5). The protective member 190 includes a base portion 191 and a plurality of, for example, four, extended portions 194. The base portion 191 extends along the lengthwise direction. The extended portions 194 extend outward from each end faces of the base portion 191 in the lengthwise direction.

The base portion 191 has a substantially downwardly open U shape in cross section extending orthogonal to the lengthwise direction. As depicted in FIG. 5, the base portion 191 of the protective member 190 is located between the guide portions 182 of the opposite side guides 180 in the lengthwise direction and within a range of a diameter of each of the guide portions 182. With this configuration, the base portion 191 is capable of supporting, from the inside of the loop of the fixing belt 110, the middle portion of the fixing belt 110 which may be a portion distant from each edge portion supported by a corresponding one of the guide portions 182 of the side guides 180. In other words, the base portion 191 is capable of supporting the middle portion of the fixing belt 110 which may be defined between the edge portions supported by the corresponding side guides 180.

"Supporting the middle portion of the fixing belt 110" includes supporting the middle portion of the fixing belt 110 in a case that the fixing belt 110 deforms (or sinks downward in its middle) due to application of an unusual force at the time of, for example, clearing a paper jam as well as in a case that the fixing belt 110 sinks downward in its middle when the fixing belt 110 rotates.

As depicted in FIGS. 3 and 5, the base portion 191 includes two each of the extended portions 194 at each end face thereof in the lengthwise direction. The extended portions 194 at each end face are spaced apart from each other in the front-rear direction. Each of the extended portions 194 extends from one of the end faces of the base portion 191 so as to protrude beyond a corresponding edge of the fixing belt 110. Each of the extended portions 194 has a through hole 194A that allows a screw SC to pass therethrough. Thus, as depicted in FIG. 4, the extended portions 194 of the protective member 190 are fastened to the corresponding mounting portions 152A of the stay 150 using the screws SC, whereby the protective member 190 is fastened to the stay 150.

Hereinafter, effects obtained by the illustrative embodiment when the fixing device 100 is in operation will be described.

As depicted in FIG. 2, as the pressing roller 170 rotates by a driving force applied to the pressing roller 170, the fixing belt 110 rotates clockwise following the rotation of the pressing roller 170. While the fixing belt 110 rotates, the fixing belt 110 may sink downward in its middle at the upper side (also referred to as an "upper-side middle portion") and thus the upper-side middle portion may move closer to the halogen lamp 120. The upper-side middle portion is distant from the edge portions of the fixing belt 110 supported and guided by the corresponding guide portions 182 (refer to FIG. 5). Even when the upper-side middle portion of the fixing belt 110 moves closer to the halogen lamp 120, the protective member 190 supports the sank middle portion of the fixing belt 110, thereby avoiding a contact of the middle portion of the fixing belt 110 and the halogen lamp 120.

According to the illustrative embodiment, more effects may be obtained in addition to the above-described effect.

The protective member 190 is fastened to the exposed end portions of the stay 150 located beyond the length of the fixing belt 110 in the lengthwise direction. This configuration may reduce or prevent the fixing belt 110 from damaging due to sliding contact with the fastened portions of the protective member 190 to the stay 150 when the fixing belt 110 rotates. In particular, in the illustrative embodiment, the protective member 190 is fastened to the stay 50 using the screws SC. Therefore, this configuration may reduce or prevent contact sliding of the fixing belt 110 relative to the screws SC.

The protective member 190 is fastened to the stay 150 made of metal having a higher rigidity, whereby the protective member 190 may be fastened to the stay 150 further appropriately.

While the disclosure has been described in detail with reference to the example drawings, it is not limited to such examples. Various changes, arrangements, and modifications may be realized without departing from the spirit and scope of the disclosure. In the description below, common parts have the same reference numerals as those of the above-described embodiments, and the detailed description of the common parts is omitted.

In the illustrative embodiment, the protective member 190 is fastened to the end portions of the stay 150 (as an example of the load receiving member) located beyond the length of the fixing belt 110 in the lengthwise direction. Nevertheless, in other embodiments, for example, one or more protective members may be provided and fastened to one or more respective positions included in a portion of the load receiving member within the length of the endless belt in the lengthwise direction (i.e., a portion of the load receiving member concealed by the fixing belt 110, hereinafter referred to as a "concealed portion").

Figure 6:
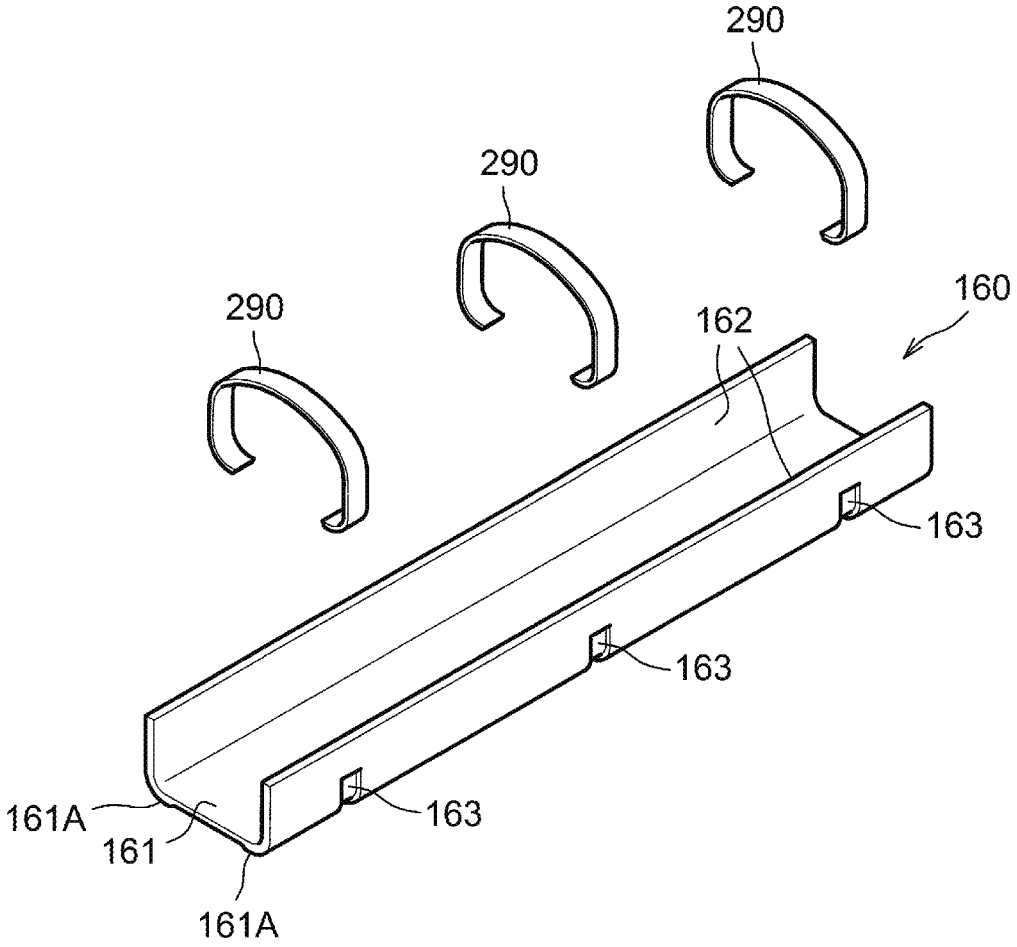
FIG. 6 is a perspective view depicting a heat insulating member and protective members which are disassembled from each other in a first variation of the illustrative embodiment according to one or more aspects of the disclosure.
Figure 7:
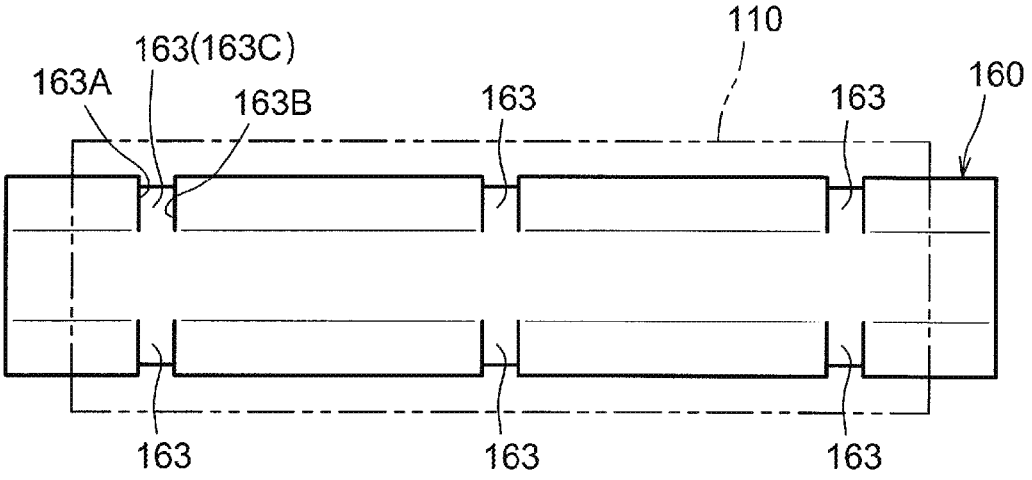
FIG. 7 is a bottom view depicting the heat insulating member in the first variation of the illustrative embodiment according to one or more aspects of the disclosure.

In a first variation, for example, as depicted in FIGS. 6 and 7, a plurality of protective members 290 having a C shape in cross section are disposed at respective positions included in the concealed portion of the heat insulating member 160 in the lengthwise direction. The heat insulating member 160 is another example of the load receiving member. More specifically, for example, the heat insulating member 160 has a plurality of grooves 163 along front and rear end portions 161A in the concealed portion thereof. The grooves 163 are spaced apart from each other in the lengthwise direction. Each groove 163 is configured to engage a corresponding one of end portions of one of the protective members 290. In opposing ones of the grooves 163 in the front-rear direction, one and the other of the opposing grooves 163 are spaced apart from each other in front-rear direction. Each of the grooves 163 extends along a circumferential direction of the fixing belt 110 from a substantially middle portion of one of the sidewall portions 162 in the up-down direction to one of the downwardly-protruding end portions 161A of the base portion 161. Thus, each of the grooves 163 opens toward the nip plate 130 that covers the heat insulating member 160.

Each of the grooves 163 has a first surface 163A, a second surface 163B, and a third surface 163C. In each groove 163, the first surface 163A extends in a direction orthogonal to the lengthwise direction. The second surface 163B extends in a direction orthogonal to the lengthwise direction and is spaced apart from the first surface 163A in the lengthwise direction. The third surface 163C may be a bottom surface of the groove 163 and connects between the first surface 163A and the second surface 163B. Each of the end portions of each of the protective members 290 is positioned between the first surface 163A and the second surface 163B of a corresponding one of the grooves 163 and held by the first surface 163A and the second surface 163B.

Figure 8A:
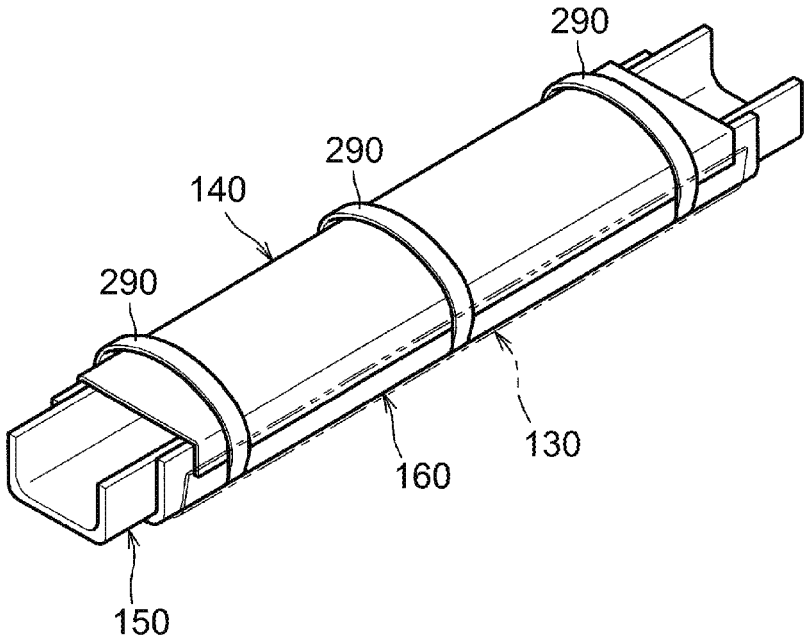
FIG. 8A is a perspective view depicting an assembly of a nip plate, the heat insulating member, a stay, a reflecting plate, and the protective members in the first variation of the illustrative embodiment according to one or more aspects of the disclosure.
Figure 8B:
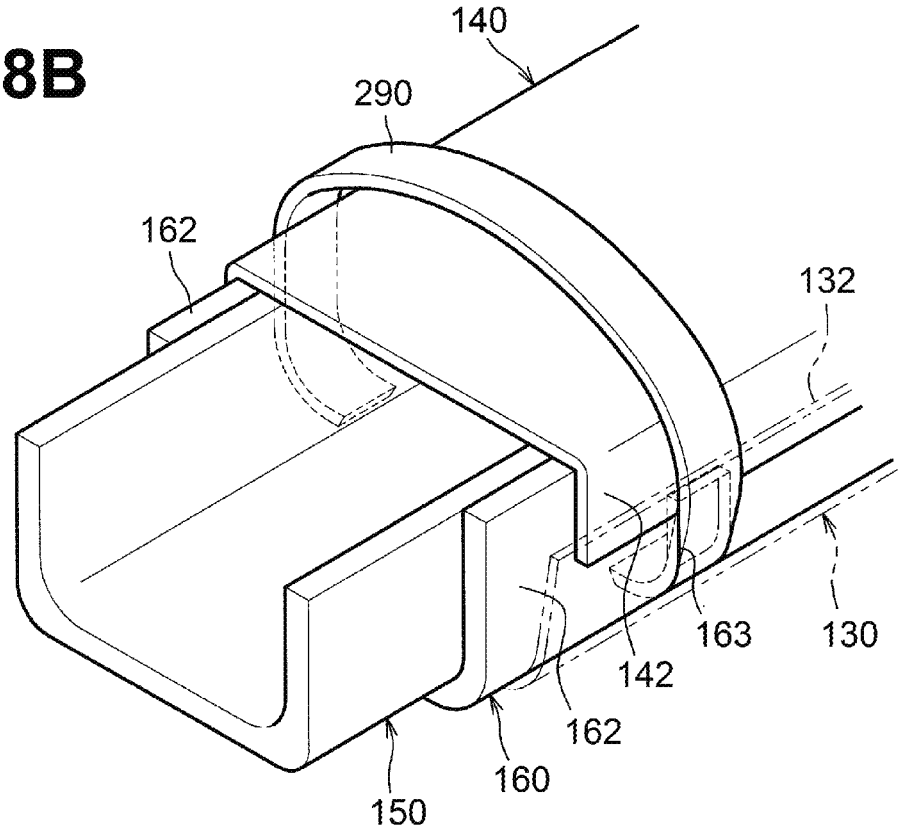
FIG. 8B is an enlarged view depicting a portion of the assembly of FIG. 8A in the first variation of the illustrative embodiment according to one or more aspects of the disclosure.

In the first variation, as depicted in FIGS. 8A and 8B, the sidewall portions 142 of the reflecting plate 140 overlap the corresponding sidewall portions 162, respectively, of the heat insulating member 160 while covering and being disposed adjacent to the corresponding sidewall portions 162 of the heat insulating member 160. As described above, in the state where the reflecting plate 140 is placed over the heat insulating member 160, each of the protective members 290 is attached to the heat insulating member 160 while each end portion of each of the protective members 290 is engaged with a corresponding one of the grooves 163. In the state where the protective members 290 are attached to the heat insulating member 160, the protective members 290 are spaced apart from each other in the lengthwise direction.

The nip plate 130 is placed under the heat insulating member 160 from below while the sidewall portions 132 of the nip plate 130 overlap and cover portions of the protective members 290. The side wall portions 132 of the nip plate 130 are positioned adjacent to the protective members 290. Since the nip plate 130 is attached in such a manner, each of the end portions of the protective members 290 is positioned and held between the nip plate 130 and the third surface 163C of a corresponding one of the grooves 163. In the first variation, the protective members 290 might not be fastened to the stay 150, and therefore, the stay 150 may have a shape in which the mounting portions 152A of the illustrative embodiment are omitted.

According to the first variation, the protective members 290 are spaced apart from each other in the lengthwise direction. With this configuration, radiant heat emitted from the halogen lamp 120 may reach the inner circumferential surface 111 of the fixing belt 110 effectively through each gap between the protective members 290. That is, in the first variation, the protective members 290 might not necessarily be made of transparent or translucent member, whereby a material cost may be reduced.

The end portions of the protective members 290 are engaged with the corresponding grooves 163. Therefore, the protective members 290 may be fastened to the heat insulating member 160 firmly without using screws.

Each of the grooves 163 extends along the circumferential direction of the fixing belt 110. Therefore, the first surface 163A and the second surface 163B of each of the grooves 163, which restrict movement of a corresponding one of the protective members 290 in the lengthwise direction, may have a larger area. Accordingly, the protective members 290 may be positioned appropriately with respect to the lengthwise direction.

Each of the end portions of the protective members 290 is positioned between the nip plate 130 and the third surface 163C of a corresponding one of the grooves 163. Therefore, the protective members 290 may be positioned appropriately with respect to a depth direction of the grooves 163.

Since the grooves 163 are provided in the heat insulating member 160 made of resin, the groove 163 may be formed easily as compared with a case where grooves are provided in the stay 150 made of metal. In the first variation, the grooves 163 are provided for positioning the protective members 290 in the lengthwise direction. Nevertheless, in other embodiments, for example, each of the protective members 290 may be held between protrusions in a corresponding pair, wherein one of the protrusions has a first surface that extends in a direction orthogonal to the lengthwise direction and the other of the protrusions has a second surface that extends in a direction orthogonal to the lengthwise direction and is spaced from the first surface in the lengthwise direction.

In the first variation, the grooves 163 are provided in each of the sidewall portions 162 of the heat insulating member 160 in the front-rear direction. Nevertheless, in other embodiments, for example, the grooves 163 may be provided in either of the sidewall portions 162 and the protective members 290 may be fastened only to the sidewall portion 162 that has the grooves 163.

In a case that the one of the sidewall portions 162 of the heat insulating member 160 is disposed upstream of the stay 150 in the conveying direction and the other of the sidewall portions 162 of the heat insulating member 160 is disposed downstream of the stay 150 in the conveying direction, it may be difficult to fasten the protective members 290 to the stay 150 since the sidewall portions 162 of the heat insulating member 160 disposed upstream and downstream, respectively, of the stay 150 obstruct attachment of the protective members 290 to the stay 150. Nevertheless, in the first variation, the protective members 290 are fastened to the sidewall portions 162 disposed upstream and downstream, respectively, of the stay 150 in the conveying direction. Therefore, this configuration may facilitate the fastening of the protective members 290 as compared with the case where the protective members 290 are fastened to the stay 150.

Figure 9:
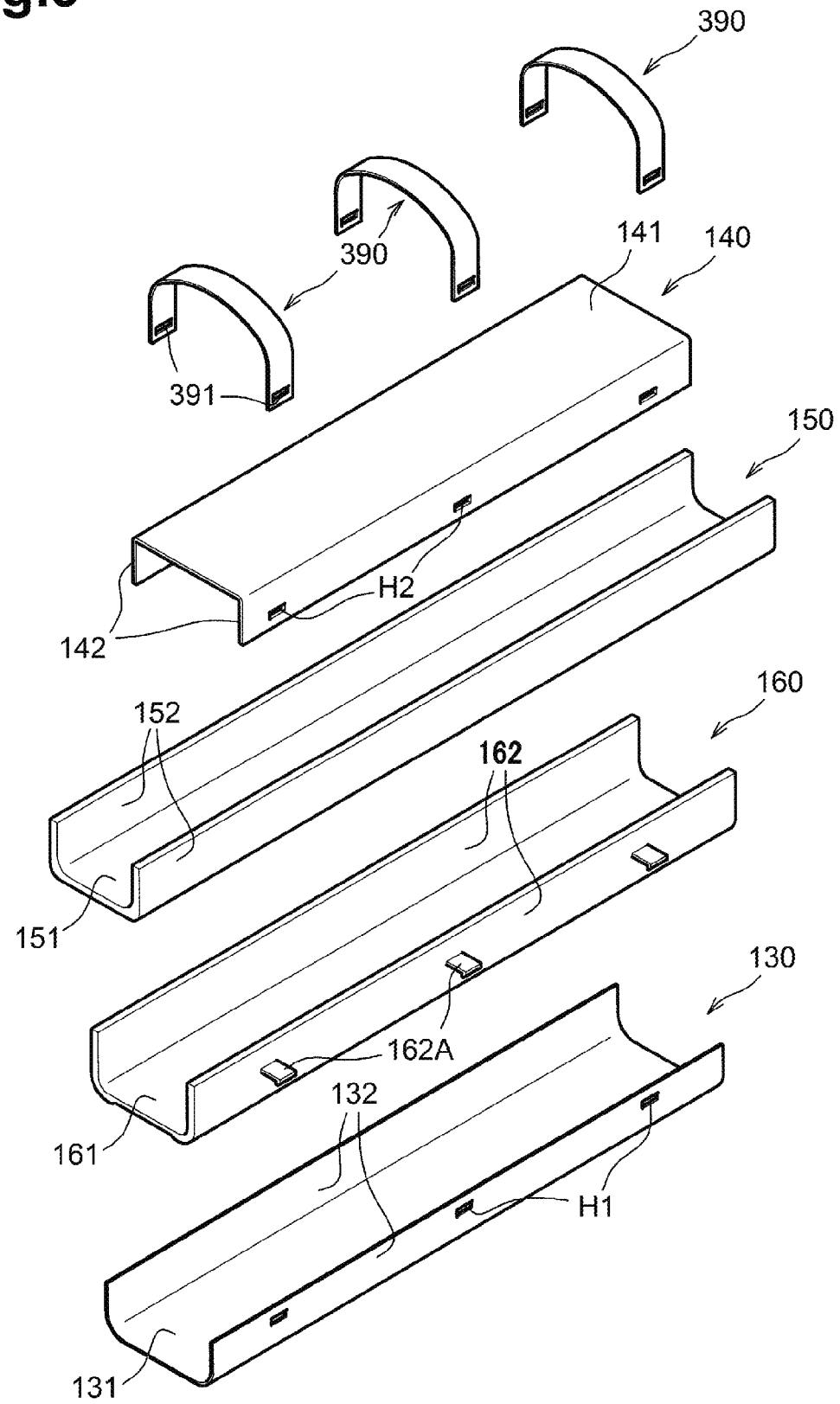
FIG. 9 is a perspective view depicting a nip plate, a heat insulating member, a stay, a reflecting plate, and protective members which are disassembled from each other in a second variation of the illustrative embodiment according to one or more aspects of the disclosure.
Figure 10:
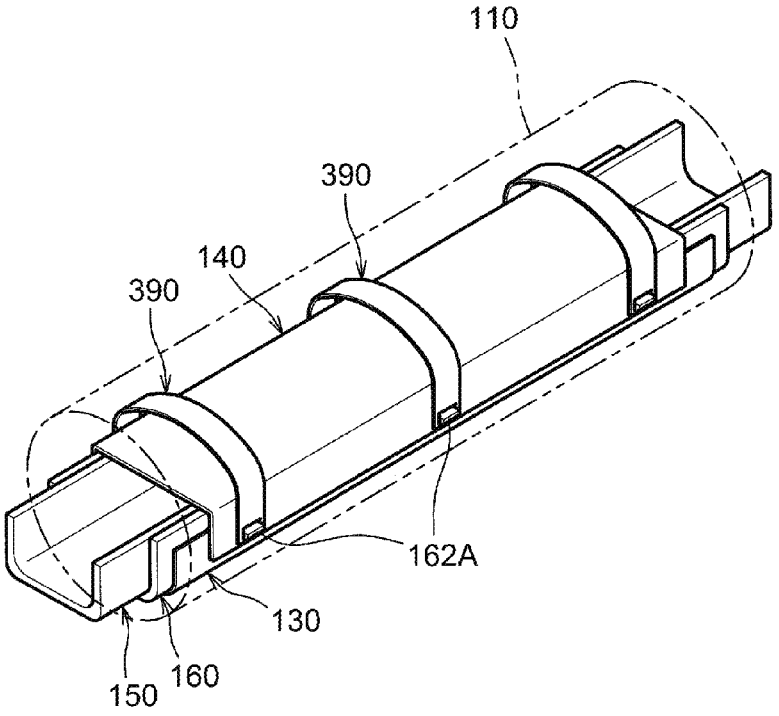
FIG. 10 is a perspective view depicting an assembly of the nip plate, the heat insulating member, the stay, the reflecting plate, and the protective members in the second variation of the illustrative embodiment according to one or more aspects of the disclosure.

The manner of fastening the protective members might not be limited to the specific example depicted in FIGS. 8A and 8B. The protective members may be fastened to respective positions included in the concealed portion of the load receiving member in the lengthwise direction in any manner. In a second variation, for example, as depicted in FIGS. 9 and 10, a heat insulating member 160 includes hooks 162A at each sidewall portion 162. Each protective member 390 has an engagement hole 391 at each end portion thereof. The protective members 390 may be fastened to the heat insulating member 160 through engagement of each of the hooks 162A of the heat insulating member 160 with a corresponding one of the engagement holes 391 of the protective members 390.

More specifically, for example, in the second variation, the protective members 390 each have a substantially U shape in cross section. Each of the protective members 390 has the engagement hole 391 at each end portion for engaging a corresponding hook 162A therewith. The protective members 390 are spaced apart from each other in the lengthwise direction.

A nip plate 130 has through holes H1 at each sidewall portion 132 for allowing the corresponding hooks 162A to pass therethrough. A reflecting plate 140 also has through holes H2 at each sidewall portion 142 for allowing the corresponding hooks 162A to pass therethrough.

The hooks 162A are provided at each of the sidewall portions 162 of the heat insulating member 160 and spaced apart from each other in the lengthwise direction. Each of the hooks 162A extends outward from an outer surface of each of the sidewall portions 162 in the front-rear direction and a distal end of each of the hooks 162A further extends downward. Each of the hooks 162A is configured to engage an external surface of a corresponding end portion of one of the protective members 390 thorough a corresponding through hole H1 of the nip plate 130, a corresponding through hole H2 of the reflecting plate 140, and a corresponding engagement hole 391 of the protective member 390. That is, in the second variation, the protective members 390 are fastened to respective positions included in the concealed portion of the heat insulating member 160 in the lengthwise direction while the reflecting plate 140 is sandwiched between the protective members 390 and the heat insulating member 160.

In the illustrative embodiment, the side guides 180 are configured to support the corresponding edge portions of the fixing belt 110. Nevertheless, in other embodiments, for example, one or more protective members for supporting the middle portion of the fixing belt may be also used for supporting the edge portions of the fixing belt 110.

In the illustrative embodiment, the halogen lamp 120 is used as an example of the heater. Nevertheless, in other embodiments, for example, a carbon heater may be used as another example of the heater.

In the illustrative embodiment, the nip plate 130 having a plate-like shape is used as an example of the nip member. Nevertheless, in other embodiments, for example, a thick pad member or a block-like member may be used as another example of the nip member. In still other embodiments, for example, a smooth sheet for enabling the endless belt to rotate smoothly relative to the nip member may be disposed between the nip member and the inner circumferential surface of the endless belt. In this case, the smooth sheet may be attached to the nip member.

The reflecting plate 140 might not necessarily be a plate member. In other embodiments, for example, a reflecting member having a thickness greater than the reflecting plate 140 may be used instead.

In the illustrative embodiment, the disclosure has been applied to the color laser printer 1. Nevertheless, in other embodiments, for example, the disclosure may be applied to any image forming apparatus, for example, a copying device or a multifunction device.

In the illustrative embodiment, the pressing roller 170 is an example of a backup member that pinches the endless belt in cooperation with the nip member. Nevertheless, in other embodiments, for example, the backup member may be a belt-shaped pressing member.

In the illustrative embodiment, the transparent or translucent member made of, for example, heat-resistant resin or heat-resistant glass is used as an example of the protective member. Nevertheless, in other embodiments, for example, a metal gauze may be used as another example of the protective member as long as it allows light to pass therethrough.

What is claimed is:

1. A fixing device comprising:

an endless belt which extends in a first direction and has end portions in the first direction and a middle portion defined between the end portions in the first direction;

a nip member configured to contact an inner circumferential surface of the endless belt;

a heater disposed inside the endless belt;

a reflecting member which is entirely disposed on a nip-member side with respect to the heater and is configured to reflect radiant heat emitted from the heater toward the inner circumferential surface of the endless belt;

a load receiving member configured to receive a load from the nip member; and a protective member which is disposed between the middle portion of the endless belt and the heater and on a side opposite to the nip member with respect to the heater and is configured to allow light to pass therethrough, wherein the protective member is fastened to the load receiving member, wherein the load receiving member has a groove, and wherein the protective member engages with the groove of the load receiving member.

2. The fixing device according to claim 1, wherein the groove of the load receiving member extends along a circumferential direction of the endless belt.

3. The fixing device according to claim 1, wherein the groove of the load receiving member opens toward the nip member, and wherein the protective member is disposed in the groove of the load receiving member and between the load receiving member and the nip member.

4. The fixing device according to claim 1, wherein the load receiving member includes a stay made of metal and a heat insulating member made of resin and disposed between the stay and the nip member, and wherein the heat insulating member has the groove of the load receiving member.

5. The fixing device according to claim 4, wherein the endless belt is configured to slide relative to the nip member in a predetermined sliding direction, wherein the heat insulating member includes:

an upstream wall disposed upstream of the stay in the predetermined sliding direction;

a downstream wall disposed downstream of the stay in the predetermined sliding direction; and an intermediate wall connecting the upstream wall and the downstream wall, and wherein the groove is defined in at least one of the upstream wall and the downstream wall.

6. A fixing device comprising:

an endless belt which extends in a first direction and has end portions in the first direction and a middle portion defined between the end portions in the first direction;

a nip member configured to contact an inner circumferential surface of the endless belt;

a heater disposed inside the endless belt;

a reflecting member which is entirely disposed on a nip-member side with respect to the heater and is configured to reflect radiant heat emitted from the heater toward the inner circumferential surface of the endless belt;

a load receiving member configured to receive a load from the nip member; and a protective member which is disposed between the middle portion of the endless belt and the heater and on a side opposite to the nip member with respect to the heater and is configured to allow light to pass therethrough, wherein the protective member is fastened to the load receiving member, wherein the load receiving member includes a stay made of metal and a heat insulating member disposed between the stay and the nip member, and wherein the protective member is fastened to the heat insulating member.

7. The fixing device according to claim 6, wherein the endless belt is configured to slide relative to the nip member in a predetermined sliding direction, wherein the heat insulating member includes:

an upstream wall disposed upstream of the stay in the predetermined sliding direction;

a downstream wall disposed downstream of the stay in the predetermined sliding direction; and an intermediate wall connecting the upstream wall and the downstream wall, and wherein the protective member is fastened to at least one of the upstream wall and the downstream wall.

8. A fixing device comprising:

an endless belt which extends in a first direction and has end portions in the first direction and a middle portion defined between the end portions in the first direction;

a nip member configured to contact an inner circumferential surface of the endless belt;

a heater disposed inside the endless belt;

a reflecting member which is entirely disposed on a nip-member side with respect to the heater and is configured to reflect radiant heat emitted from the heater toward the inner circumferential surface of the endless belt;

a load receiving member configured to receive a load from the nip member; and a protective member which is disposed between the middle portion of the endless belt and the heater and on a side opposite to the nip member with respect to the heater and is configured to allow light to pass therethrough, wherein the protective member is fastened to the load receiving member, and wherein the protective member is a metal gauze.

9. The fixing device according to claim 8, wherein the load receiving member includes an end portion located beyond the endless belt in the first direction, and wherein the protective member is fastened to the end portion of the load receiving member.

10. The fixing device according to claim 9, wherein the protective member is fastened to the end portion of the load receiving member using a screw.

11. The fixing device according to claim 8, wherein the load receiving member includes a stay made of metal, and wherein the protective member is fastened to the stay.

12. The fixing device according to claim 8, wherein the protective member is fastened to a portion of the load receiving member, and wherein the portion of the load receiving member is positioned within the endless belt.

13. The fixing device according to claim 12, further including a plurality of protective members spaced apart from each other in the first direction.

14. The fixing device according to claim 12, wherein the load receiving member includes a first surface and a second surface which are spaced apart from each other in the first direction, and wherein the protective member is disposed between the first surface and the second surface of the load receiving member.

15. The fixing device according to claim 8, further comprising a pressing roller configured to contact an outer circumferential surface of the endless belt.

16. The fixing device according to claim 8, wherein the reflecting member includes a base portion and sidewall portions extending from corresponding end portions of the base portion on the nip-member side.

17. The fixing device according to claim 8, wherein the end portions of the endless belt include a first end portion and a second end portion in the first direction, and wherein the fixing device further comprises:

a first side guide configured to guide the inner circumferential surface of the first end portion of the endless belt; and a second side guide configured to guide the inner circumferential surface of the second end portion of the endless belt.

* * * * *